United States Patent [19]

Mellor

[11] Patent Number: 4,839,553

[45] Date of Patent: Jun. 13, 1989

[54] REFLECTOR LAMP HAVING COMPLEMENTARY DICHROIC FILTERS ON THE REFLECTOR AND LENS FOR EMITTING COLORED LIGHT

[75] Inventor: Charles E. Mellor, Salem, Mass.

[73] Assignee: GTE Products Corporation, Danvers, Mass.

[21] Appl. No.: 135,804

[22] Filed: Dec. 21, 1987

[51] Int. Cl.[4] ..... H01K 1/26; H01K 1/30

[52] U.S. Cl. ..... 313/111; 313/112; 313/113

[58] Field of Search ..... 313/111, 112, 113, 114; 350/163, 164, 165, 166

[56] References Cited

U.S. PATENT DOCUMENTS

| | | | |
|---|---|---|---|
| 3,188,513 | 6/1965 | Hansler | 313/112 |
| 4,241,391 | 12/1980 | Pitkjaan et al. | 313/579 X |
| 4,588,923 | 5/1986 | Hoegler et al. | 313/112 X |
| 4,701,663 | 10/1987 | Kawakatsu et al. | 313/112 |

*Primary Examiner*—Kenneth Wieder

*Attorney, Agent, or Firm*—Joseph S. Romanow

[57] ABSTRACT

The present invention is directed to a sealed beam lamp comprising a lens and a reflector, both of which have been coated with a multiple series of thin, very high temperature resistant alternating dichroic coatings, most preferably $TiO_2$ and $SiO_2$. The lamps of the present invention produce brilliantly colored light and may be constructed as compact, high wattage, glass or epoxy sealed fixtures, with numerous possible focussing constuctions.

17 Claims, 4 Drawing Sheets

BLUE REFLECTOR COATING

BLUE LENS COATING

BLUE REFLECTOR COATING

RED LENS COATING

GREEN REFLECTOR COATING

GREEN LENS COATING

YELLOW REFLECTOR COATING

YELLOW LENS COATING

REFLECTOR LAMP HAVING COMPLEMENTARY DICHROIC FILTERS ON THE REFLECTOR AND LENS FOR EMITTING COLORED LIGHT

BACKGROUND OF THE INVENTION

The present invention is directed to colored sealed beam lamps formed from tungsten-halogen sources, a multilayer dichroic coated reflector and a multilayer dichroic coated lens.

Colored lighting is desirable in display lighting, environmental lighting, for stadium score boards, message boards and for many architectural, artistic or theatrical applications. Colored lighting is the preferred method for warning indication and direction signaling such as for traffic lighting, instrument panel lighting runway light and heliport lighting.

Currently these functions are accomplished by the use of filtered incandescent lamps. The lamps naturally emit white or yellow-white light with very high color rendering index, thus are not color selective. The lamp is contained in a fixture in all of the above applications, and the fixture is fitted with a filtering device such as a plastic lens, colored glass lens, or in some applications a changeable filtering device which holds flat filter sheets. In another filtering method, the lamp envelope is made large in relation to the wattage so that the envelope is normally cool, and the exterior is coated with a semi-transparent paint or plastic film.

Many of the above described disadvantages may be eliminated if a tungsten-halogen capsule is permanently mounted inside of a dichroic coated concave reflector, with a dichroic coated lens sealed on by glass fusing methods, frits, or by epoxies.

Such a construction is widely utilized in the Sylvania Capsylite TM, and in most modern automobile headlights. Using such methods, lamps up to 350 Watts can be designed for lives in excess of 3000 hours.

Dichroic coatings on lamp reflectors as above have previously been used as cold mirrors or hot mirrors, or as color filters or reflectors in fixtures. See for example, Cooper, U.S. Pat. No. 3,527,974. However, the use of thin film coatings as a color filter integral to the lamp has been limited in the past because of the intense heat generated by small high wattage lamps, which causes degradation of the coating and thus the color.

SUMMARY OF THE INVENTION

It has been discovered that colored lamps can be made using a tungsten-halogen capsule, which will have no further need of filtering, by the proper incorporation of two multilayer coatings, one on the lens, the other on the reflector, each being integral to both lamp function and design. The coatings are permanently sealed within a controlled atmosphere.

A lamp with a coated reflector, light source and with or without a lens is limited in the range of hue and intensity to colors which are only slightly discernible from the unfiltered light of the light source.

The function of the present invention is to provide complete light filtering by means of a system of coatings where the lens is coated with a selective dichroic filter, and the reflector is coated with a complementary selective dichroic filter which enhances the forward reflectance of a selected color, and minimizes the forward reflectance of unwanted visible light. This combination of coatings will decrease the projection of unwanted colors by approximately two orders of magnitude more than the single filter reflective or transmissive systems such as those described by Cooper, supra.

Also, since the coatings of the present invention are sealed inside a hermetic atmosphere, they are not subject to environmental effects other than the normal heat of operation of the light source. The coatings of the present invention can therefore be expected to retain good color performance for the entire life of the light source.

In addition the preferred design of the dichroic reflector coating is such that it reflects a portion of the visible light and transmits a greater portion of the infrared light from the light source. This allows for cool operation of the front of the lamp. The lens coating preferably transmits a portion of the desired visible spectrum, and reflects the remainder of the visible spectrum, which is in turn transmitted by the selective reflector coating. Thus the light projected forward is composed only of the selected wavelengths, and all unwanted visible and infra-red wavelengths are rejected.

The coatings of the present invention are formed from multiple alternating thin layers of transparent dichroic materials, with different refractive indexes, preferably, titanium dioxide and silicon dioxide, deposited on the lens and/or the reflector, for example by electron beam or other thermal vacuum evaporation techniques. As used herein, the term "multilayer" refers to at least 6 individual alternating dichroic layers (e.g., $SiO_2$ and $TiO_2$), preferably at least 10 individual layers, and most preferably at least 15 individual layers.

In preferred embodiments, the substrate lenses and reflectors are placed into a coating fixture in a vacuum chamber which is then evacuated. The substrates are heated by radiant heaters such as quartz lamps or "calrods" to a predetermined temperature. Thin layers of each coating material are then deposited in succession so that a multilayer coating is formed. Each individual layer in the multilayer coating may range from about 15 nm (nanometers) to about 400 nm, preferably from about 100 nm to 300 nm thick.

The preferred lens multilayer coating of the present invention comprises from thirteen to twenty five alternating layers of silicon dioxide and titanium dioxide. Using the preferred coating methods described above, the refractive index of the silicon dioxide is 1.47 and the titanium dioxide is 2.21. In one lens design the first layer nearest the lens substrate is preferably silicon dioxide with an optical thickness of $\frac{1}{8}$ wave. The remaining layers are $\frac{1}{4}$ wave thick, except the outermost layer which is 1/12 wave thick.

In a second lens coating design, the first layer nearest the glass substrate is preferably silicon dioxide as described above, and the remaining layers are $\frac{1}{4}$ or $\frac{1}{2}$ wave thick. In this design, the layer arrangement is known to a person skilled in the art as a periodic stack comprising three five layer periods with the middle layer of each period being $\frac{1}{2}$ wave thick. A $\frac{1}{4}$ wave thick layer of silicon dioxide is located between each period and a $\frac{3}{8}$ wave thick layer of silicon dioxide is located as the outermost layer.

It has been found that the outermost layer comprising a $\frac{3}{8}$ wave is most likely to result in the highest possible transmission over the life of the light source. While not wishing to be bound by theory, this is assumed to be a result of residual oxidation activity of the outermost layer during lamp sealing operations and during operation of the lamp when the lens coating normally reaches a temperature above 150° C. where further oxidation of the outermost coating layer is possible.

The preferred reflector coating of the present invention comprises from ten to twenty three alternating layers of silicon dioxide and titanium dioxide. Using the coating methods described above, the refractive index of the silicon dioxide is 1.47 and the titanium dioxide is 2.21. The first layer nearest the glass substrate is preferably silicon dioxide with an optical thickness of $\frac{1}{8}$ wave. The remaining layers are $\frac{1}{4}$ wave thick, except the outermost layer which is $\frac{1}{2}$ wave thick.

The use of such coatings, together with sealed beam construction methods, additionally prevents harmful ultra-violet light (generated by the tungsten-halogen capsule) from being projected out of the lamp, through the combined effects of absorption in the lens coating, glass substrate, and minimal forward reflection on the reflector coating.

Still another advantage of this invention is the greater tolerance of manufacture of the coated lamp parts disclosed herein. In the prior art and common lamp usage, thin film coatings are designed and produced to filter light and create pure colors but the layer thickness tolerances, spectral selection and uniformity of coating tolerance are very severe, so that such use of coatings to create pure colors is very expensive and subject to errors in fixture alignment, focussing changes and environmentally induced changes to the filter.

The present invention solves all of these problems in an economical way for the user, the manufacturer of the lighting sources, and also for the fixture manufacturer who is no longer forced to design fixtures comprising fragile or expensive filter parts.

DETAILED DESCRIPTION OF THE PREFERRED EMBODIMENT

The present invention is directed to a sealed beam lamp comprising a lens and a reflector, each of which have been coated with a series of thin, very high temperature resistant alternating dichroic coatings, most preferably $TiO_2$ and $SiO_2$.

The lamps of the present invention produce brilliantly colored light and may be constructed as compact, high wattage, glass or epoxy sealed fixtures, with numerous possible focussing constructions. The lamps of the present invention can replace larger, low temperature colored PAR systems, they eliminate the need for filtered fixtures, and they dispense with the use of expensive colored glass.

The coatings employed in the lamps of the present invention are so durable that they do not significantly change or degrade during the rated life of the bulb, which may exceed 3000 hours at 350° C.

The lamps of the present invention may be designed to produce any of a variety of hues and intensities. However, the principal colors of interest in the preferred embodiments of the present invention were blue, green, yellow, red, and magenta.

The present invention will be illustrated by means of the following examples, which are intended to assist in the understanding of the present invention, but are not to be construed as limiting the scope thereof. In each of the following examples, the individual coatings on both the reflector and the lens are formed in vacuo, by electron beam deposition, under quartz lamp heaters.

Figure 13:
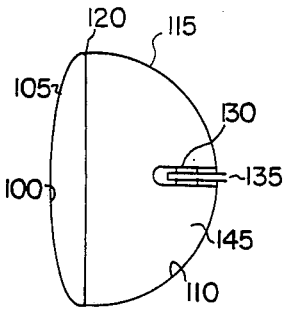
FIG. 13 illustrates the preferred lamp of the present invention, showing the component parts thereof.

The preferred lamp of the present invention is illustrated in FIG. 13. In this invention, the interior concave surface 100 of a borosilicate glass lens 105 is coated and the interior, concave surface 110 of a borosilicate parabolic glass reflector 115 is coated.

Figure 14:
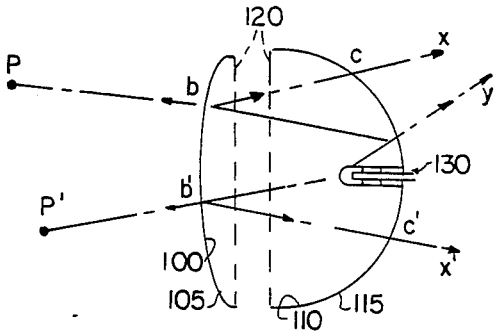
FIG. 14 illustrates the operating principles of the coatings of the present invention, transmission of selected wavelengths of light out of the front of the lamp, combined with directing unwanted light out through the rear of the reflector.

The operation of the preferred lamp of the present invention is illustrated in FIG. 14. Light P′ is direct light of a desired wavelength emitted by the light source 130 and transmitted through the coated lens 100/105 at point b′. The light filtered by both the reflector coating 110/115 and the lens coating 100/105 is labeled P. This light is initially filtered at point "a" in the rear wall of the reflector with light of unwanted wavelengths "Y" exiting the rear of the reflector. Light P is again filtered at point b by the lens coating which directs unwanted wavelengths of light X and X′ toward the rear of the lamp where it exits.

In the examples provided infra, the reflector used is known in the trade as PAR-16 and the lens used is known as NARROW SPOT PAR-16, which is fitted to the reflector.

The interior surface of the reflector is smooth, and the interior surface of the lens is knurled or figured with hemispherical projections approximately 0.5 mm radius. As will be recognized by the skilled artisan, all of the coatings of the present invention will operate similarly with reflectors and lenses of differing sizes, surface configurations or focal lengths than those used for the examples herein.

Upon consideration of the following examples, those skilled in the art of dichroic coatings will be readily able to select additional coating combinations and fabricate lamps according to the teachings of the present invention, which will duplicate any of the colors of the visible spectrum.

Manufactured coating designs are known to persons with ordinary skill in the art to be different from theoretical coating designs because of variations in material properties, manufacturing equipment and process, and glass substrate configurations materially affect the resultant optical character of the coating. Manufactured coating designs are used by persons skilled in the art to produce results identical to those results expected from the theoretical coating designs.

EXAMPLE 1

Figure 1:
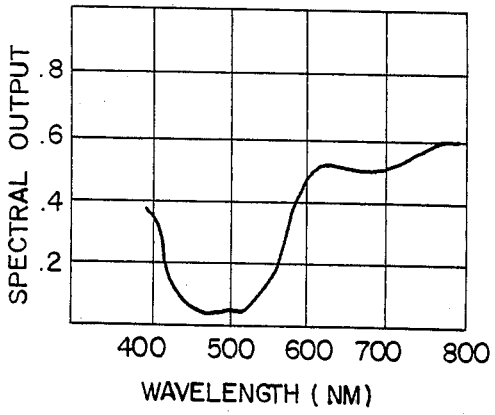
FIGS. 1, 3, 5, and 7 illustrate the spectral transmissions for the blue, red, green, and yellow reflectors of the present invention, respectively.
Figure 9A:
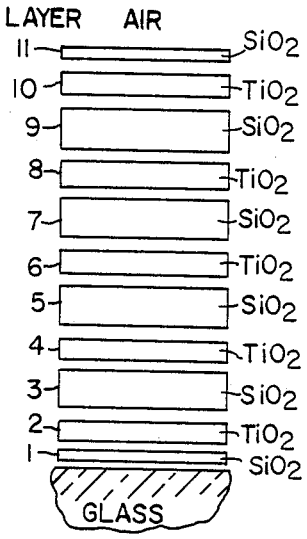
FIGS. 9A, 10A, 11A, and 12A illustrate the multilayer dichroic reflector coatings for the preferred blue, red, green, and yellow reflectors of the present invention, respectively.

To produce brilliant blue light, the multilayer reflector coating for the PAR 16 system is designed to reflect only the blue portion of the spectrum (see, FIGS. 1 and 9A), and the remainder of both the visible spectrum and the infra-red is transmitted.

Figure 2:
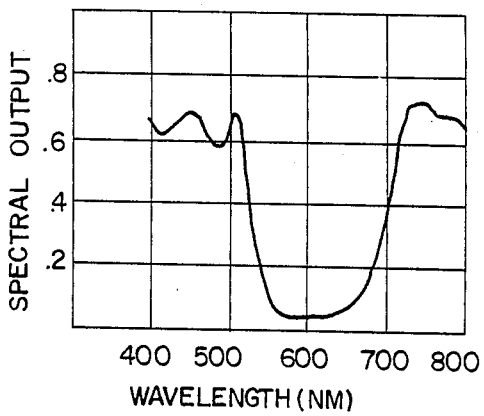
FIGS. 2, 4, 6, and 8 illustrate the spectral transmissions for the blue, red, green, and yellow lenses of the present invention, respectively.
Figure 9B:
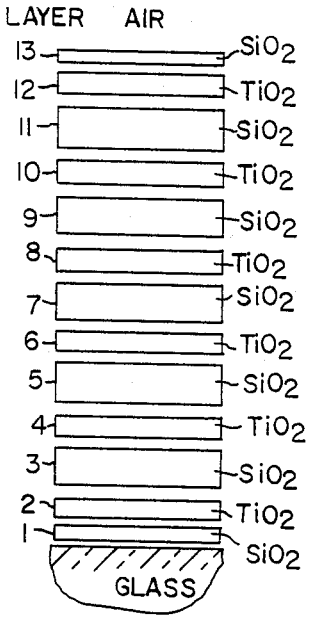
FIGS. 9B, 10B, 11B, and 12B illustrate the multilayer dichroic lens coatings for the preferred blue, red, green, and yellow lenses of the present invention, respectively.

The multilayer lens coating is designed for the PAR-16 system so that the blue reflected light is transmitted (see, FIGS. 2 and 9B), and the greater part of the visible spectrum consisting of green and yellow light is reflected. The green and yellow light then passes out through the reflector and is thus removed from the projected beam, giving a light system with a high purity of blue light.

TABLE 1A

Multilayer Coating Design for Blue Reflector

| Layer # | Material | Thickness |
|---|---|---|
| | Glass Substrate | |
| 1 | $SiO_2$ | 85 nm |
| 2 | $TiO_2$ | 180.0 |
| 3 | $SiO_2$ | 271.0 |
| 4 | $TiO_2$ | 180.0 |
| 5 | $SiO_2$ | 271.0 |
| 6 | $TiO_2$ | 180.0 |
| 7 | $SiO_2$ | 271.0 |
| 8 | $TiO_2$ | 180.0 |
| 9 | $SiO_2$ | 271.0 |
| 10 | $TiO_2$ | 180.0 |
| 11 | $SiO_2$ | 110.0 |
| | Air | |

TABLE IB

Multilayer Coating Design for Blue Lens

| Layer # | Material | Thickness |
|---|---|---|
| | Glass Substrate | |
| 1 | $SiO_2$ | 112.5 nm |
| 2 | $TiO_2$ | 115.0 |
| 3 | $SiO_2$ | 172.5 |
| 4 | $TiO_2$ | 115.0 |
| 5 | $SiO_2$ | 172.5 |
| 6 | $TiO_2$ | 115.0 |
| 7 | $SiO_2$ | 172.5 |
| 8 | $TiO_2$ | 115.0 |
| 9 | $SiO_2$ | 172.5 |
| 10 | $TiO_2$ | 115.0 |
| 11 | $SiO_2$ | 172.5 |
| 12 | $TiO_2$ | 115.0 |
| 13 | $SiO_2$ | 345.0 |
| | Air | |

The combination of lens and reflector multilayer coatings produces a brilliant, deep sky-blue color. The C.I.E. chromatic coefficients are; $x=0.258$, $y=0.254$, and $z=0.488$. The color produced by the reflector alone was $x=0.371$, $y=0.365$, and $z=0.264$. The color improvement produced by adding the coated lens is clearly evident.

EXAMPLE 2

Figure 3:
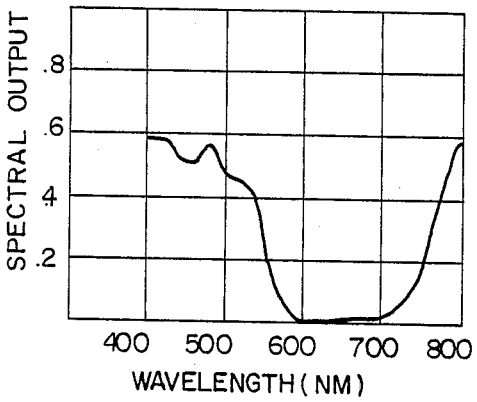

To produce red light, the multilayer reflector coating is designed to reflect only the red portion of the visible spectrum (see, FIGS. 3 and 1OA), while the remainder of the visible spectrum and the infra-red is transmitted.

Figure 4:
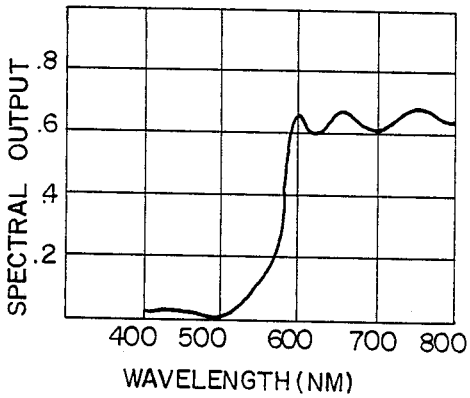
Figure 10A:
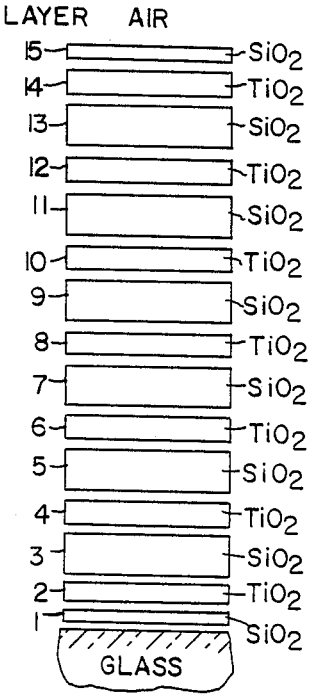
Figure 10B:
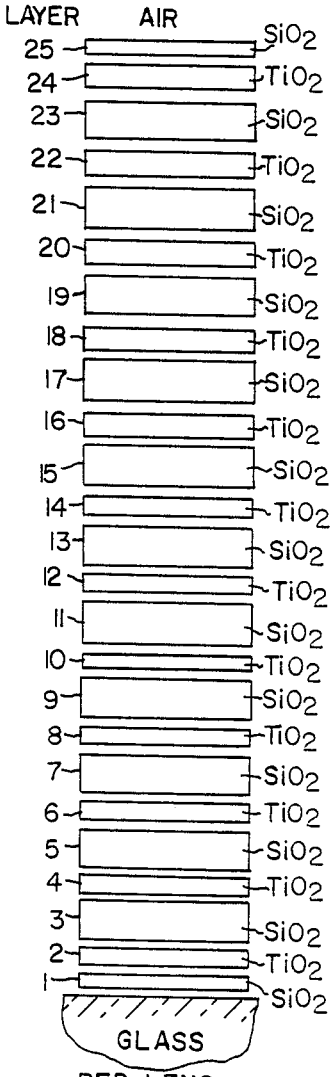

The multilayer lens coating is designed so that only the red reflected light is transmitted (see, FIGS. 4 and 10B), and the greater part of the visible spectrum consisting of blue, green and orange-yellow light is reflected. This unwanted light then passes through the reflector and is thus removed from the projected beam.

TABLE 2A

Multilayer Coating Design for Red Reflector

| Layer # | Material | Thickness |
|---|---|---|
| | Glass Substrate | |
| 1 | $SiO_2$ | 110.0 nm |
| 2 | $TiO_2$ | 241.0 |
| 3 | $SiO_2$ | 378.0 |
| 4 | $TiO_2$ | 241.0 |
| 5 | $SiO_2$ | 378.0 |
| 6 | $TiO_2$ | 241.0 |
| 7 | $SiO_2$ | 378.0 |
| 8 | $TiO_2$ | 241.0 |
| 9 | $SiO_2$ | 378.0 |
| 10 | $TiO_2$ | 241.0 |
| 11 | $SiO_2$ | 378.0 |
| 12 | $TiO_2$ | 241.0 |
| 13 | $SiO_2$ | 378.0 |
| 14 | $TiO_2$ | 241.0 |
| 15 | $SiO_2$ | 0.850 |
| | Air | |

TABLE 2B

Multilayer Coating Design for Red Lens

| Layer # | Material | Thickness |
|---|---|---|
| | Glass Substrate | |
| 1 | $SiO_2$ | 45.0 nm |
| 2 | $TiO_2$ | 90.0 |
| 3 | $SiO_2$ | 136.0 |
| 4 | $TiO_2$ | 90.0 |
| 5 | $SiO_2$ | 136.0 |
| 6 | $TiO_2$ | 90.0 |
| 7 | $SiO_2$ | 136.0 |
| 8 | $TiO_2$ | 90.0 |
| 9 | $SiO_2$ | 136.0 |
| 10 | $TiO_2$ | 90.0 |
| 11 | $SiO_2$ | 136.0 |
| 12 | $TiO_2$ | 90.0 |
| 13 | $SiO_2$ | 102.5 |
| 14 | $TiO_2$ | 67.5 |
| 15 | $SiO_2$ | 102.5 |
| 16 | $TiO_2$ | 67.5 |
| 17 | $SiO_2$ | 102.5 |
| 18 | $TiO_2$ | 67.5 |
| 19 | $SiO_2$ | 102.5 |
| 20 | $TiO_2$ | 67.5 |
| 21 | $SiO_2$ | 102.5 |
| 22 | $TiO_2$ | 67.5 |
| 23 | $SiO_2$ | 102.5 |
| 24 | $TiO_2$ | 67.5 |
| 25 | $SiO_2$ | 35.0 |
| | Air | |

The combined multilayer coatings produce a deep red color. The C.I.E. chromatic coefficients are; $x=0.612$, $y=0.371$, and $z=0.017$. The color produced by the reflector alone is $x=0.512$, $y=0.432$, and $z=0.056$. The dramatic color improvement produced by adding the coated lens is clearly evident.

EXAMPLE 3

Figure 5:
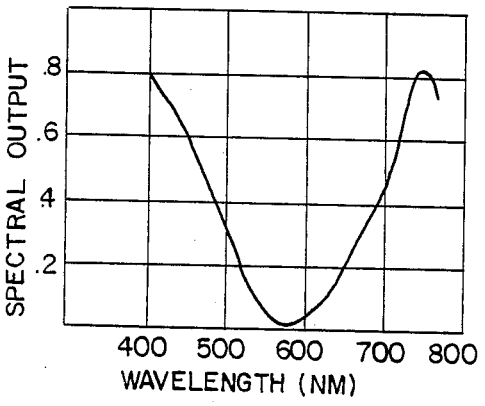

To produce green light, the multilayer reflector coating is designed to reflect the blue-green portion of the visible spectrum (see, FIGS. 5 and IIA), while the remainder of the visible spectrum and the yellow, red and infra-red emissions are transmitted.

Figure 6:
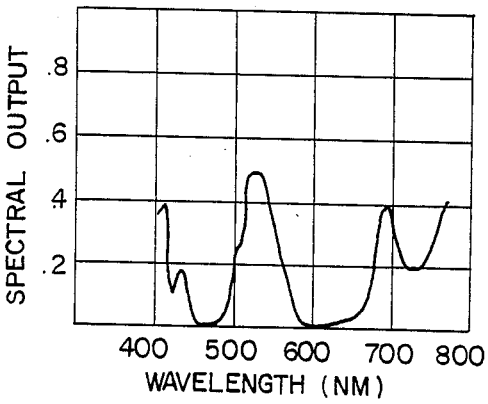
Figure 11A:
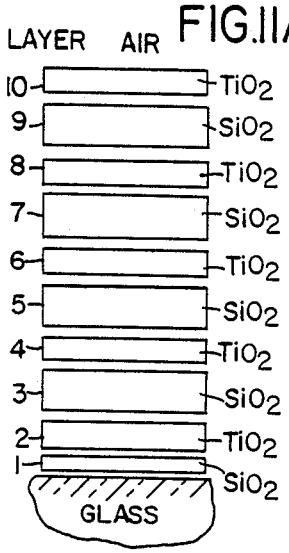
Figure 11B:
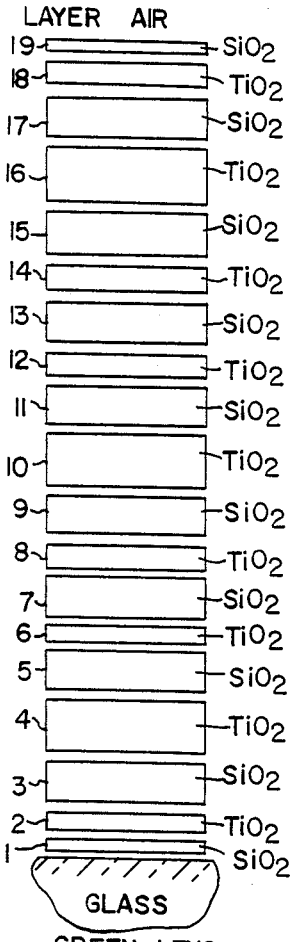

The multilayer lens coating is designed as a bandpass so that the green reflected light is transmitted (see, FIGS. 6 and 11B), and the greater part of the visible spectrum consisting of blue, yellow and red light is reflected. This light then passed through the reflector and is thus removed from the projected beam.

TABLE 3A

| Multilayer Coating Design for Green Reflector | | |
|---|---|---|
| Layer # | Material | Thickness |
| | Glass Substrate | |
| 1 | $SiO_2$ | 110.0 nm |
| 2 | $TiO_2$ | 237.0 |
| 3 | $SiO_2$ | 371.0 |
| 4 | $TiO_2$ | 237.0 |
| 5 | $SiO_2$ | 371.0 |
| 6 | $TiO_2$ | 237.0 |
| 7 | $SiO_2$ | 371.0 |
| 8 | $TiO_2$ | 237.0 |
| 9 | $SiO_2$ | 371.0 |
| 10 | $TiO_2$ | 237.0 |
| | Air | |

TABLE 3B

| Multilayer Coating Design for Green Lens | | |
|---|---|---|
| Layer # | Material | Thickness |
| | Glass Substrate | |
| 1 | $SiO_2$ | 48.0 nm |
| 2 | $TiO_2$ | 96.5 |
| 3 | $SiO_2$ | 145.0 |
| 4 | $TiO_2$ | 193.0 |
| 5 | $SiO_2$ | 145.0 |
| 6 | $TiO_2$ | 96.5 |
| 7 | $SiO_2$ | 145.0 |
| 8 | $TiO_2$ | 96.5 |
| 9 | $SiO_2$ | 145.0 |
| 10 | $TiO_2$ | 193.0 |
| 11 | $SiO_2$ | 145.5 |
| 12 | $TiO_2$ | 96.5 |
| 13 | $SiO_2$ | 145.0 |
| 14 | $TiO_2$ | 96.5 |
| 15 | $SiO_2$ | 145.0 |
| 16 | $TiO_2$ | 193.0 |
| 17 | $SiO_2$ | 145.0 |
| 18 | $TiO_2$ | 96.5 |
| 19 | $SiO_2$ | 48.0 |
| | Air | |

The combined coatings produce a pleasant green color. The C.I.E. chromatic coefficients are; x=0.382, y=0.574, and z=0.044. The color produced by the reflector alone is x=0.402, y=0.430, and z=0.168. The dramatic color improvement produced by adding the coated lens is evident.

EXAMPLE 4

Figure 7:
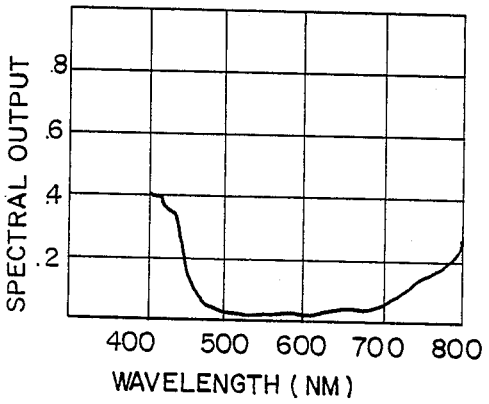
Figure 12A:
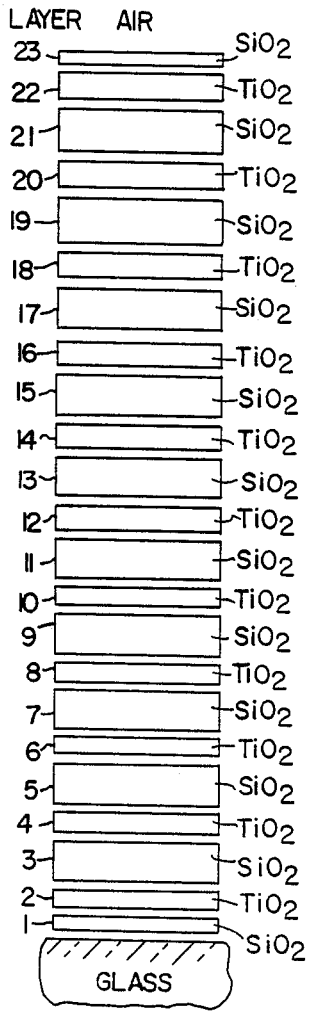

To produce yellow light, the multilayer reflector coating is designed to reflect only the green-red portion of the visible spectrum (see, FIGS. 7 and 12A), while the remainder of the visible spectrum and the infra-red is transmitted.

Figure 8:
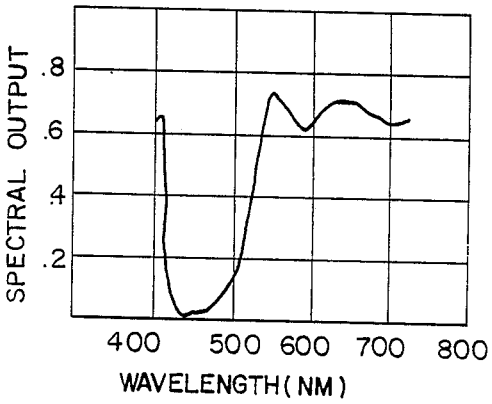
Figure 12B:
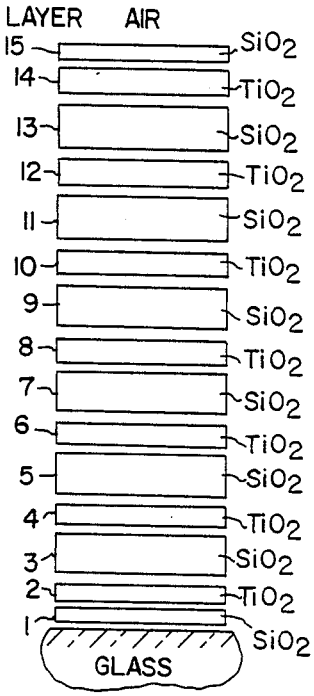

The multilayer lens coating is designed so that the yellow-red reflected light is transmitted (see, FIGS. 8 and 12B), and the greater part of the visible spectrum consisting of mostly blue is reflected. This light then passes through the reflector and is thus removed from the projected beam.

TABLE 4A

| Multilayer Coating Design for Yellow Reflector | | |
|---|---|---|
| Layer # | Material | Thickness |
| | Glass Substrate | |
| 1 | $SiO_2$ | 110.0 nm |
| 2 | $TiO_2$ | 230.0 |
| 3 | $SiO_2$ | 360.0 |
| 4 | $TiO_2$ | 230.0 |
| 5 | $SiO_2$ | 360.0 |
| 6 | $TiO_2$ | 230.0 |
| 7 | $SiO_2$ | 360.0 |
| 8 | $TiO_2$ | 230.0 |

TABLE 4A-continued

| Multilayer Coating Design for Yellow Reflector | | |
|---|---|---|
| Layer # | Material | Thickness |
| | Glass Substrate | |
| 9 | $SiO_2$ | 360.0 |
| 10 | $TiO_2$ | 230.0 |
| 11 | $SiO_2$ | 360.0 |
| 12 | $TiO_2$ | 230.0 |
| 13 | $SiO_2$ | 280.0 |
| 14 | $TiO_2$ | 180.0 |
| 15 | $SiO_2$ | 280.0 |
| 16 | $TiO_2$ | 180.0 |
| 17 | $SiO_2$ | 280.0 |
| 18 | $TiO_2$ | 180.0 |
| 19 | $SiO_2$ | 280.0 |
| 20 | $TiO_2$ | 180.0 |
| 21 | $SiO_2$ | 280.0 |
| 22 | $TiO_2$ | 180.0 |
| 23 | $SiO_2$ | 85.0 |
| | Air | |

TABLE 4B

| Multilayer Coating Design for Yellow Lens | | |
|---|---|---|
| Layer # | Material | Thickness |
| | Glass Substrate | |
| 1 | $SiO_2$ | 115.0 nm |
| 2 | $TiO_2$ | 115.0 |
| 3 | $SiO_2$ | 172.5 |
| 4 | $TiO_2$ | 115.0 |
| 5 | $SiO_2$ | 172.5 |
| 6 | $TiO_2$ | 115.0 |
| 7 | $SiO_2$ | 172.5 |
| 8 | $TiO_2$ | 115.0 |
| 9 | $SiO_2$ | 172.5 |
| 10 | $TiO_2$ | 115.0 |
| 11 | $SiO_2$ | 172.5 |
| 12 | $TiO_2$ | 115.0 |
| 13 | $SiO_2$ | 172.5 |
| 14 | $TiO_2$ | 115.0 |
| 15 | $SiO_2$ | 345.0 |
| | Air | |

The combined coatings produce a bright yellow color. The C.I.E. chromatic coefficients are; x=0.485, y=0.455, and z=0.060. The color produced by the reflector alone is x=0.455, y=0.420, and z=0.125. The color improvement produced by adding the coated lens is clearly seen.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A reflector lamp which emits colored light, said lamp comprising:

(a) a reflector partially enclosing an interior, said reflector having a first dichroic filter thereon, said first filter having the ability to reflect a desired band of wavelengths of visible light and to transmit substantially all other wavelengths;

(b) a tungsten-halogen light-source capsule mounted within said interior; and (c) a lens mounted on said reflector such that said interior is hermetically closed, said lens having a second dichroic filter thereon, said second filter having the ability to transmit said desired band of wavelengths of visible light and to reflect substantially all other wavelengths;

(d) whereby said lamp emits colored light, the color of said light being determined by said desired band of wavelengths of visible light.

2. A reflector lamp as described in claim 1 wherein each of said first and second dichroic filter includes a plurality of layers and each of said layers has a thickness falling within the range of approximately fifteen to approximately four hundred nanometers.

3. A reflector lamp as described in claim 2 wherein each of said first and second dichroic filters is formed from alternating layer of first and second materials, respectively, and the refractive index of said first material is different than the refractive index of said second material.

4. A reflector lamp as described in claim 3 wherein said first dichroic filter employs silicon dioxide as said first material and titanium dioxide as said second material.

5. A reflector lamp as described in claim 3 wherein said second dichroic filter employs silicon dioxide as said first material and titanium dioxide as said second material.

6. A reflector lamp as described in claim 2 wherein said first dichroic filter includes fifteen or more layers.

7. A reflector lamp as described in claim 2 wherein said second dichroic filter includes fifteen or more layers.

8. A reflector lamp as described in claim 2 wherein each layer of said first dichroic filter has a thickness falling within the range of approximately one hundred to three hundred nanometer.

9. A reflector lamp as described in claim 2 wherein each layer of said second dichroic filter has a thickness falling within the range of approximately one hundred to three hundred nanometers.

10. A reflector lamp as described in claim 4 wherein the refractive index of said silicon dioxide layers is approximately 1.47 and the refractive index of said titanium dioxide layers is approximately 2.1.

11. A reflector lamp as described in claim 5 wherein the refractive index of said silicon dioxide layers is approximately 1.47 and the refractive index of said said titanium dioxide layers is approximately 2.21.

12. A reflector lamp as described in claim 1 wherein the color of said emitted light is blue.

13. A reflector lamp as described in claim 1 wherein the color of said emitted light is red.

14. A reflector lamp as described in claim 1 wherein the color of said emitted light is green.

15. A reflector lamp as described in claim 1 wherein the color of said emitted light is yellow.

16. A reflector lamp as described in claim 1 wherein said lamp is a signal lamp.

17. A reflector lamp as described in claim 16 wherein said signal lamp is employed on a vehicle.

* * * * *